United States Patent [19]

Roberts

[11] 4,347,207

[45] Aug. 31, 1982

[54] METHOD OF EXTRUDING POLYPROPYLENE YARN

[75] Inventor: John S. Roberts, Howell, N.J.

[73] Assignee: Kling-Tecs, Inc., Mantoloking, N.J.

[21] Appl. No.: 244,810

[22] Filed: Mar. 17, 1981

Related U.S. Application Data

[63] Continuation-in-part of Ser. No. 229,012, Jan. 27, 1981, which is a continuation-in-part of Ser. No. 127,360, Mar. 15, 1980, Pat. No. 4,303,606, which is a continuation of Ser. No. 893,371, Apr. 4, 1978, Pat. No. 4,193,961.

[51] Int. Cl.[3] ..... D01D 5/22

[52] U.S. Cl. ..... 264/176 F; 264/211; 425/208

[58] Field of Search ..... 425/208, 72 S; 264/176 F, 211

[56] References Cited

U.S. PATENT DOCUMENTS

| | | | |
|---|---|---|---|
| 3,650,652 | 3/1972 | Dray et al. | 425/208 |
| 4,193,961 | 3/1980 | Roberts | 264/176 F |
| 4,225,299 | 9/1980 | Roberts | 264/176 F |

FOREIGN PATENT DOCUMENTS

| | | | |
|---|---|---|---|
| 2311657 | 12/1976 | France | 425/208 |

*Primary Examiner*—Jay H. Woo

*Attorney, Agent, or Firm*—Edward D. C. Bartlett

[57] ABSTRACT

An extruder screw for extruding solution dyed polypropylene at low temperatures, for example, in the range 335° F. to 365° F., has feed, transition and metering sections, the length of the transition section being at least equal to the sum of the lengths of the feed and metering sections. The transition section has a compression ratio of at least 4.5:1 to create substantial backflow of the melt therein to thoroughly mix the melt. The transition section may be a continuous compression zone or have two compression portions connected by a dwell portion.

12 Claims, 4 Drawing Figures

METHOD OF EXTRUDING POLYPROPYLENE YARN

RELATED APPLICATIONS

This application is a continuation-in-part of my co-pending application Ser. No. 229,012 titled "Method of Extruding Polypropylene Yarn" filed Jan. 27, 1981, which is a continuation-in-part of co-pending application Ser. No. 127,360 filed Mar. 15, 1980, (subsequently issued as U.S. Pat. No. 4,303,606) which is a continuation of application Ser. No. 893,371 filed Apr. 4, 1978 and now issued as U.S. Pat. No. 4,193,961.

FIELD OF THE INVENTION

This invention relates to the extrusion of polypropylene filaments or the like, particularly solution dyed multifilament polypropylene yarn, and to extruder screws therefor.

BACKGROUND OF THE INVENTION

My U.S. Pat. No. 4,193,961 discloses a method of producing multifilament polypropylene yarn comprising heating polypropylene having a narrow molecular weight distribution with a swell value, or die swell, of less than 3 to a temperature at which it is molten, and extruding the molten polypropylene at a temperature less than 425° F. into a plurality of filaments. The filaments are passed through a hot zone having a temperature sufficiently high to retard cooling of the filaments therein. The filaments are drawn down to their undrawn denier in the hot zone and then passed through a quenching zone in which cooling gas is directed over them. The combination of the swell value of the polypropylene, the temperature of extrusion, and the temperature of the hot zone interact to substantially eliminate the occurrence of resonance in the filaments as they are drawn down in the hot zone.

It was then discovered that when the extrusion temperature is dropped sufficiently below the region of 400° F., unexpectedly uniform yarn can be produced with improved drawing characteristics. This is more fully described in my above-mentioned co-pending application Ser. No. 229,012 titled "Method of Extruding Polypropylene Yarn" filed Jan 27, 1981, which is hereby incorporated by reference.

With low extrusion temperatures, such as below 385° F. and particularly below 365° F., it was discovered that adiabatic conditions started occurring in the extruder as the rate of extrusion was increased. This could be somewhat controlled by using blowers to cool the metering and mixing zones of the extruder, but this is not a satisfactory long-term solution. It could also probably be controlled by increasing the depth of undercut in the metering zone of the extruder screw. However, it was desired to retain a shallow undercut in the metering zone to enhance mixing of the melt in the extruder when producing solution dyed yarns.

SUMMARY OF THE INVENTION

The present invention is concerned with eliminating the above-mentioned adiabatic conditions at higher rates of extrusion with low extrusion temperatures without resorting to blowers and without reducing the mixing capabilities of the extruder screw.

Accordingly, it is an object of the present invention to provide an extruder screw for use in low temperature extrusion of polypropylene which will substantially eliminate the occurrence of adiabatic conditions at higher throughput rates of extrusion and effect good mixing of the melt.

It is another object of the invention to provide a method of extruding polypropylene filaments at low temperatures and higher throughput rates with substantial elimination of the occurrence of adiabatic conditions.

It is still another object of the invention to provide a method of extruding polypropylene yarn having a high degree of uniformity.

It is a further object of the invention to provide a method of extruding high quality solution dyed polypropylene yarn.

Towards the accomplishment of the aforementioned objects and others which will become apparent from the following description and accompanying drawings, there is disclosed an extruder screw for extruding polypropylene or the like, comprising a screw flight extending substantially the effective length of the screw, and screw flight defining a feed section, a transition section, and a metering section, the depth of the undercut of said screw flight decreasing through said transition section in the direction of feed. The length of said transition section is at least the sum of the lengths of said feed metering sections. The ratio of the depth of said undercut in said feed section to that in said metering section is at least 4.5:1. The feed section is preferably substantially shorter in length than said metering section, for example, the feed section may be approximately one-third of the length of the metering section. The transition section is preferably at least 1.5 times the length of the metering section. The ratio of the depth of the undercut in said feed section to that in the metering section may be less than 6.5:1, and is preferably in the range 5:1 to 6:1.

The transition section may have a continuously decreasing depth of undercut throughout its length. Alternatively, the transition section may comprise two compression portions of decreasing depth of undercut with an intermediate dwell portion of constant depth of undercut, and the length of the dwell portion is preferably greater than the sum of the lengths of the two compression portions. The transition section may occupy 50 percent to 65 percent of the effective length of the screw.

There is also disclosed a method of extruding polypropylene filaments or the like comprising feeding polypropylene in the form of pellets to a feed section of an extruder, passing the pellets to a long transition section of the extruder, the transition section decreasing in depth by a ratio of at least 4.5:1 from the beginning to the end thereof in the direction of feed. The pellets are melted in the transition section, and the resultant melt is thoroughly mixed therein by a substantial backflow of the melt. The temperature of the melt is controlled at less than 425° F., preferably less than 385° F., as the melt passes from the transition zone by applying external heat to the transition zone. The melt is passed through a metering section of the extruder, the length of the transition section being at least equal to the sum of the lengths of the metering and feed sections. Then the melt is extruded at a controlled temperature less than 425° F., preferably less than 385° F., into a plurality of filaments or the like.

The application of heat to the transition section preferably occurs at a plurality of locations along the length thereof, the heat being applied at a lower temperature the nearer the location is to the metering section. For example, there may be three such locations with heat being applied at the first at least 10° F. above the desired extrusion temperature, heat being applied at the second location at a temperature at least 5° F. above the extrusion temperature, and the third zone, adjacent the metering section, being controlled at the same temperature as the extrusion temperature.

The temperature to which the melt is heated in the transition section and the extrusion temperature may be in the range 335° F. to 365° F., for example, 340° F. to 355° F., or 350° F. to 360° F., but preferably 340° F. to 355° F.

When producing 300 denier multifilament polypropylene yarn, the rate of extrusion may be 7 or more pounds per hour per yarn, for example, at least 8 pounds per hour per yarn, and even 9 pounds per hour.

The extruder preferably has a length/diameter ratio of at least 25:1, for example, approximately 30:1.

Specific embodiments of the invention will now be described in detail with reference to the accompanying drawings.

DESCRIPTION OF THE PREFERRED EMBODIMENTS

Figure 1:
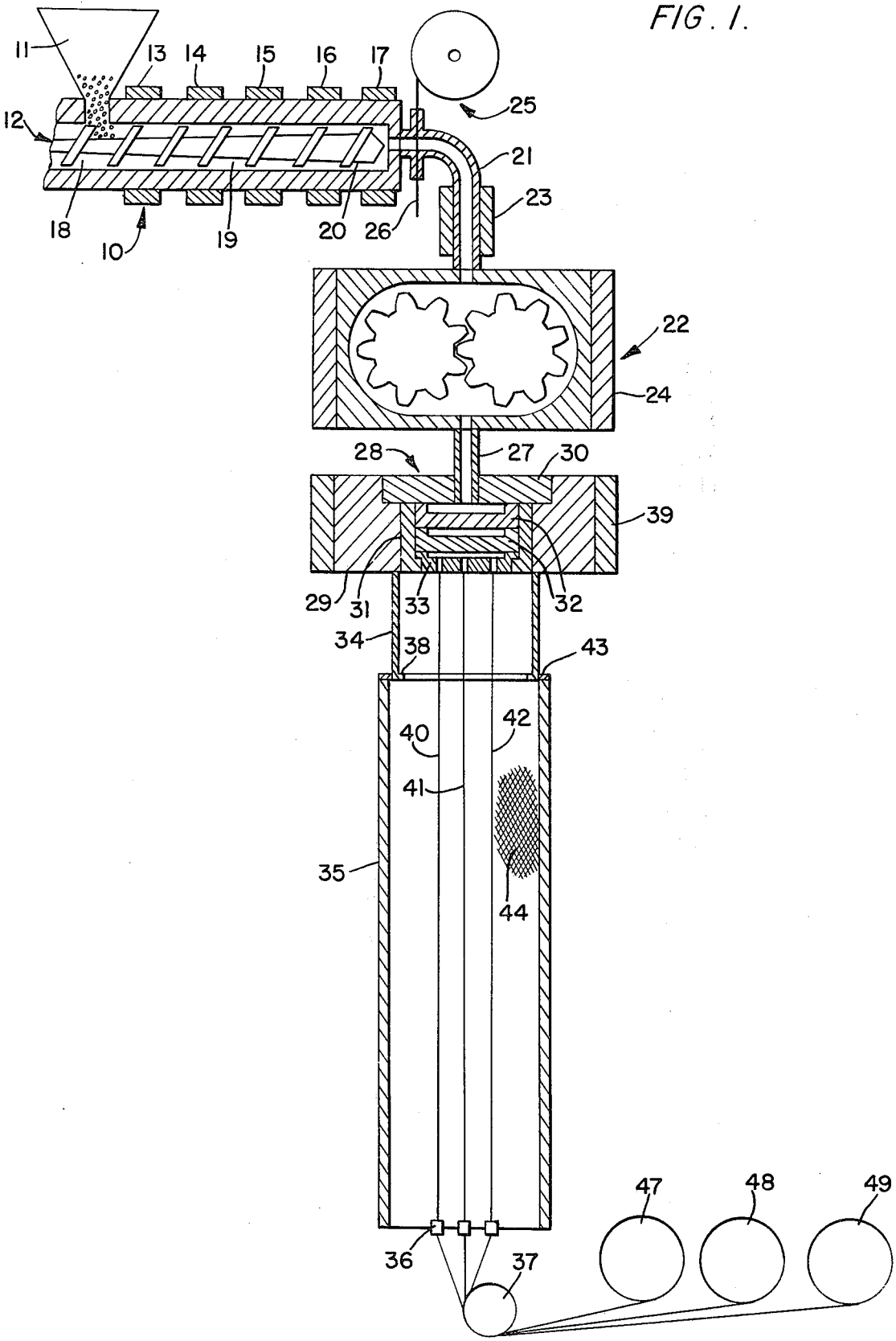
FIG. 1 is a schematic vertical section of an extrusion apparatus for carrying out the method of the invention and employing an extruder screw according to the invention.

Embodiments of the invention will first be described generally with reference to FIG. 1 which shows an extruder 10 having an infeed hopper 11, a screw 12, and five band heaters 13, 14, 15, 16, and 17. The screw 12 has a short feed section 18, a long transition section 19, and a medium length metering section 20 with no mixing head, and will be described in greater detail later. A transfer tube 21 connects the discharge end of the extruder 10 to a metering pump 22. The transfer tube 21 and the metering pump 22 are surrounded by band heaters 23 and 24, respectively.

An automatic screen shifter 25 is mounted adjacent the end of the extruder with a continuous screen 26 passing through the transfer tube 21. This screen shifter is more fully described in U.S. Pat. Nos. 3,940,335, 3,856,674, and 3,471,017. The discharge side of the metering pump 22 is connected by a tube 27 to a spin pack 28 mounted in a spin block 29 which is surrounded by a band heater 39. The spin pack 28 has a cover plate 30, a pack body 31, two identical breaker plates 32, and a spinnerette 33. Both of the breaker plates 32 and the spinnerette 33 have shallow horizontally extending cavities in their upper surfaces containing a series of wire mesh screens. For simplicity, the usual heat insulation that covers the band heaters and other parts of the apparatus is not shown. A shroud 34 is attached to the underside of the spin block 29. Below the shroud 34 is mounted an air quench cabinet 35 at the bottom of which are three finish applying guides 36. Just below the guides 36 is a denier control roll 37.

The shroud 34 defines a rectangle in horizontal section. At the lower end of the shroud 34 is an inwardly directed flange 38.

The spinnerette 33 has capillaries arranged in three groups to produce three multifilament yarns 40, 41, and 42.

The quench cabinet 35 has a top cover 43 which fits closely around the outside of the flange 38. The back wall of the quench cabinet 35 is formed of wire mesh 44. The front wall is left open to atmosphere. A cooling plenum registers with the back of the wire mesh 44. In cross-section the quench cabinet is rectangular, similar to the shroud 34 and the face of the spinnerette 33 with the groups of capillaries in the spinnerette spaced apart in a direction parallel to the longer sides of these rectangles.

The shroud 34 is relatively short and fits closely around the spinnerette 33 but with sufficient clearance so that the yarns 40, 41, and 42, if they sway, do not come in contact with the inner edge of the flange 38. The longer side of the shroud 34 is approximately 12 inches and the shorter side approximately 7 inches; the length of the face of the spinnerette 33 is approximately 8 inches and the width approximately 4 inches. The height of the shroud 34 is approximately 8 inches.

For more details of other parts of the extrusion line see my U.S. Pat. No. 4,225,299 which is hereby incorporated by reference.

Still referring to FIG. 1, in operation pellets of polypropylene resin and pellets of color concentrate are fed via the hopper 11 into the extruder 10. The polypropylene has a narrow molecular weight distribution with a die swell or swell value below 3, preferably below 2.5 and in the range 1.2 to 1.7, and a melt flow greater than 30, preferably about 40. The resin and color pellets are melted and heated by the extruder heaters and the shearing action in the transition section 19 to a temperature less than 425° F., preferably less than 385° F. such as in the range 340° F. to 355° F. The melt so produced is thoroughly mixed in the long transition section 19. The heaters 13, 14, 15, 16, and 17 are set to control the temperatures of their zones as will be described more fully later. The downstream heaters 23, 24, 39 are set to control the temperatures of their zones at the chosen extrusion temperature. The melt is fed by the metering section 20 of the screw 12 through the transfer tube 21 to the metering pump 22 which delivers a metered stream of melt through the tube 27 to the spin pack 28. Inside the spin pack this metered stream is hydraulically split and extruded downwards through the capillaries of the spinnerette 33 into the multitude of filaments forming the three spaced apart multifilament yarns 40, 41, and 42. The number of capillaries in the spinnerette is chosen to determine the number of filaments in each yarn. These yarns pass through the shroud 34, which defines a hot zone, and are then cooled as they pass through the quench cabinet 35. The cooling of the yarns is effected by blowing ambient air at 100 to 200 feed per minute transversely across them, the air entering the quench cabinet through the wire mesh 44 and being exhausted directly to atmosphere. The cooled yarns then pass through the guides 36 which apply spin finish to them before they are brought together around the denier control roll 37, after which the three yarns are separated and wound onto separate packages 47, 48, and 49. The denier control roll 37 pulls the yarns down from the spinnerette 33 at a controlled rate to determine their undrawn denier. This drawing-down of the filaments to their undrawn denier is arranged to occur in the shroud 34. Put another way, the extruded filaments are elongated by a predetermined ratio while in the hot zone to determine their undrawn denier.

The air inside the shroud 34 is trapped there and remains quiescent. This air is heated by the metal above it, namely, the face of the spinnerette 33, the lower end of the pack body 31 and part of the spin block 29, these being heated by the spin block heater 39. The molten filaments leaving the spinnerette 33 also heat this air. In this way, the air inside the shroud 34 remains hot at a temperature close to or just below, the temperature of the melt being extruded and prevents substantial cooling of the filaments as they pass therethrough, that is, the temperature in the shroud 34 is sufficiently high to retard cooling of the filaments. The temperature in the lower portion of the shroud 34 may be at a lower temperature than in the upper portion, but is sufficiently high to retard cooling of the filaments. The combination of the swell value of the polypropylene, the low temperature of extrusion, and the temperature of the hot zone interact to substantially eliminate the occurrence of resonance in the filaments as they are drawn down in the hot zone. Also, with very low temperatures of extrusion below 375° F. unexpectedly uniform yarns can be produced with superior drawing characteristics. Further, with extrusion temperatures below 385° F., particularly in the range 350° F. to 360° F., exceptional results have been obtained with the spin pack 28, having a low internal volume with two breaker plates and three shallow cavities containing sets of wire mesh screens, regarding the speed and completeness with which color changes can be purged through the spin pack.

When 900 undrawn denier 70 filament yarn is produced by the above method, and subsequently drawn at a draw ratio of, for example, 3:1 to a continuous filament nominal 300 denier 70 filament textile face yarn, the yarn will be uniform with substantially no resonance symptoms and have improved uniformity of denier from filament to filament.

For the production of finer denier per filament yarns, it is preferable to use narrow molecular weight distributed polypropylene with a high melt flow, for example, in the range 35 to 45, or above, and with a low swell value, for example, in the range 1.2 to 1.7, preferably below 1.5. Also, a higher draw ratio, for example, 4:1 may be necessary.

Embodiments of the extruder screw 12 and their operation according to the invention will now be described in greater detail with reference to FIGS. 2, 3, and 4.

Figure 2:
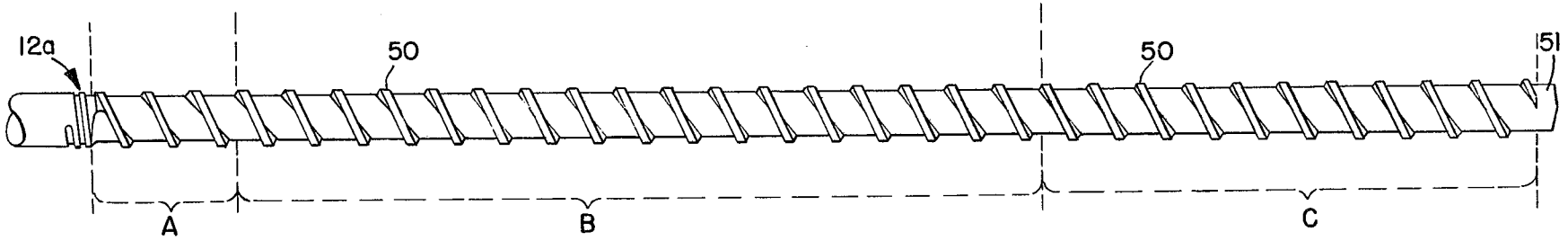
FIG. 2 is an elevation view of the extruder screw in FIG. 1.

FIG. 2 shows the preferred extruder screw **12*a* having a continuous helical screw flight 50 extending through the effective length of the extruder screw. The screw flight, due to differences in the depth of undercut, defines a short feed section A having three convolutions of the screw flight, a long transition section B having seventeen convolutions of the screw flight, and a medium length metering section C having ten convolutions. The end of the screw 12*a* terminates in a blunt nose 51 with no mixing head. The depth of the undercut is constant throughout the feed section A and the metering section C, but continuously reduces throughout the transition section B in the direction of feed, i.e., towards the nose 51, from the depth in the feed section A to the depth in the metering section C. The ratio of the depth of undercut in the feed section A to that in the metering section C is 5.7:1; that is, the screw 12*a* has a compression ratio of 5.7:1. The depth of undercut is the depth of cut made in the extruder screw below the outside diameter of the screw flight to define the screw flight; put another way, the depth of undercut is equal to the height of the screw flight. The ratio of the effective length of the screw 12*a*** to its diameter is 30:1. The dimensions of the screw are:

Effective length—90 inches

Outside diameter—3 inches

Depth of undercut in feed section A—0.400 inches

Depth of undercut in metering section C—0.070 inches

Pitch of screw flight 50—3 inches

Width of screw flight 50—0.375 inches

The radial clearance between the outside diameter of the screw flight 50 and the bore of the extruder barrel is approximately 0.040 inch throughout the feed section A, 0.015 inch throughout the transition section B, and 0.007 inch throughout the metering section C. A conventional 3 inch extruder screw would have about a 3.5:1 compression ratio with a maximum throughput capacity of about 320 lbs./hr. However, screw **12*a*** has a reduced maximum capacity of about 220 lbs./hr. due to the shallow undercut in the metering section C.

In operation, the heater bands 13, 14, 15, 16, and 17 are set to control the temperatures of their zones to 330° F., 360° F., 350° F., 345° F., and 345° F., respectively. Heater band 13 surrounds the feed section A. Heater bands 14, 15, and 16 surround three zones of the transition section B, and heater band 17 surrounds the metering section C. It should be noted that heat is applied to the feed section A at the melting temperatures of polypropylene. Heat is applied to the metering section C at the desired extrusion temperature. And heat is applied to the three heated zones of the transition section B along a reverse temperature gradient starting 15° F. above the extrusion temperature, reducing to 5° F. above the extrusion temperature, and finally at the extrusion temperature. The rate of extrusion throughput is set in the range 168 and 200 lbs./hr. The melt in the transfer tube 21 is split four ways to four twin outlet metering pumps 22 to supply eight spin packs 28 to produce twenty-four 900 denier 72 filament undrawn yarns. The long transition section B at first feeds and starts compressing the mixture of resin and color concentrate pellets. The shearing action by the screw flight 50 on the pellets starts to melt them together with the relatively high temperature of the band heater 14. The transition section B then feeds a mixture of melt plus pellets, with the air entrapped between the pellets being gently forced back through the feed throat of the extruder up through the hopper 11. As the temperature of the pellets and melt rises, the remaining pellets will melt while still in the transition section B. Due to the high compression ratio of the transition section, the melt is subjected to considerable backflow through the clearance between the screw **12*a* and the barrel of the extruder 10. This action thoroughly mixes the melt and evenly distributes the color therethrough. When the last portion of the transition section B delivers the melt to the metering section C, the melt will have reached the chosen extrusion temperature and mixing been completed. The metering section C then pumps the melt forwards without the need for any further mixing. The length of the transition section, 0.57 times the effective length of the screw, allows a more gradual transformation from pellets, to pellets plus melt, to all melt. The object of this, particularly at a low temperature, is to reduce "working" of the pellets, that is, reducing the rate of generation of heat in shearing the pellets into a melt. In this way, the occurrence of an adiabatic condition in the transition section, despite the desired high compression ratio, can be avoided. The higher temperature of the first heated zone (band heater 14) of the transition section B is to accelerate earlier melting of the pellets in that section. Under certain conditions of extrusion, such as at the higher rates of throughput at the lower extrusion temperatures, it may be necessary to cool the extruder barrel in the location of band heater 13** by use of a water jacket employing controlled temperature hot water in order to prevent melting of any pellets in the feed section A.

Figure 3:
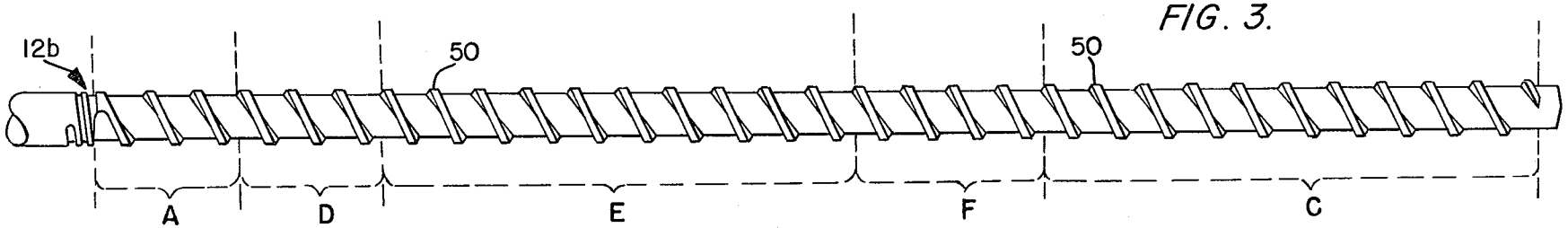
FIG. 3 is an elevational view of another embodiment of the extruder screw.

FIG. 3 shows another extruder screw 12*b* according to the invention. The feed section A and metering section C of the screw 12*b* are identical to those sections of the screw 12*a* shown in FIG. 2. However, the transition section has two short compression portions D and F connected by an intermediate dwell portion E. The first compression portion D contains three convolutions of the screw flight 50 and is 9 inches long. The dwell portion E contains ten convolutions of the flight 50 and is 30 inches long. The second compression portion F contains four convolutions of the screw flight and is 12 inches long. The depth of the undercut in the dwell portion E is 0.350 inches. This gives a compression ratio of 1.14:1 for portion D and a compression ratio of 5:1 for portion F with the transition section D, E, F still having an overall compression ratio of 5.7:1. The heater bands 13, 14, 15, 16, and 17 are arranged to control zones around D, E (first half), E (second half), F, and C, respectively. In operation the temperatures of these zones should be controlled at 370° F., 350° F., 350° F., 345° F., and 345° F., respectively, for an extrusion temperature of 345° F. The feed section A should be controlled at 330° F.

Figure 4:
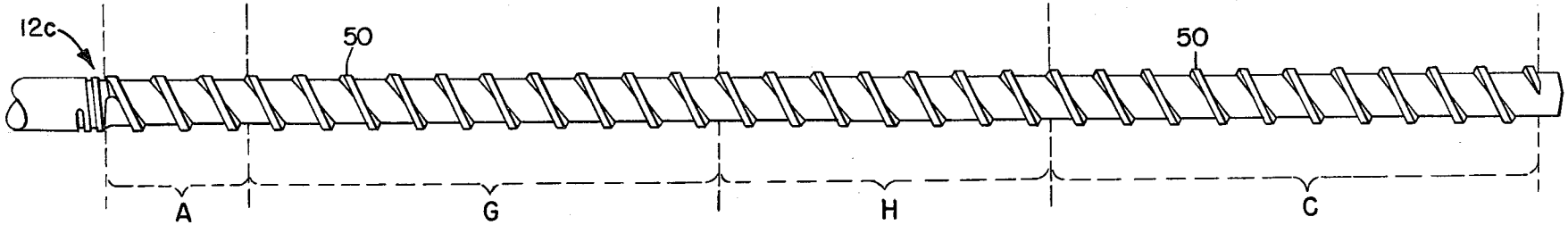
FIG. 4 is an elevational view of yet another embodiment of the extruder screw.

FIG. 4 shows another form of extruder screw 12*c* according to the invention. The feed section A and the metering section C of the screw 12*c* are identical to those of the screw 12*a* in FIG. 2. However, the transition section has a dwell portion G and a compression portion H. The dwell portion G contains ten convolutions of the screw flight 50 and is 30 inches long. The compression portion H contains and is defined by seven convolutions of the screw flight 50 and is 21 inches long. The depth of undercut throughout the dwell portion G is 0.350 inch, with a very abrupt change at the beginning thereof from the undercut of 0.400 inch throughout the feed section A. The depth of undercut in the compression portion H changes continuously from 0.350 inch to 0.070 inch. Thus, there is a compression ratio of 1.14:1 on entering the dwell section G, and the compression portion H has a compression ratio of 5:1 giving the transition section G and H an overall compression ratio of 5.7:1. The heater bands 13, 14, 15, 16, and 17 are arranged to control zones around A, G (first half), G (second half), H, and C, respectively. In operation the temperature of these zones should be controlled at 330° F., 370° F., 350° F., 345° F., and 345° F., respectively.

It should be noted that polypropylene pellets have a bulk density of about 40 lbs. per cubic foot, as opposed to polypropylene flake which has a bulk density of about 20 to 22 lbs. per cubic foot, and waste polypropylene fiber which has a bulk density of the order of 10 lbs. per cubic foot. Thus, the compression ratio of the transition section is extremely high for polypropylene pellets, particularly at low extrusion temperatures. However, the mixing capability of such a transition section is extremely good. Color letdowns of 30:1 to 50:1 can be accommodated, i.e., by volume 30 to 50 parts of polypropylene pellets to one part of color concentrate pellets, with complete mixing and uniformity of color.

Although it is preferred to introduce the color concentrate pellets into the polypropylene pellets in the feed hopper 11, it is also possible to premix these pellets. Further, the color concentrate can be in liquid form instead of pellets if desired. The low extrusion temperatures enable some lower cost temperature sensitive pigments to be used, for example, diarylide yellow, without any fear of being degraded by the temperature of extrusion; also, iron oxide can be used without fear of it degrading the polypropylene.

Narrow molecular weight distribution polypropylene is usually made by thermal degradation of reactor resin, although this can be done chemically. The object is to degrade the high molecular weight material. The swell value is the ratio of the diameter of the extrudate just below the face of the spinnerette divided by the diameter of the capillary through which it is being extruded. This should be measured using a capillary with basically zero land (length to radius ratio not greater than 0.221) at a temperature of 190° C. and at a shear rate of one thousandth of a second. Shear rate equals four times the volumetric flow rate (q in cubic centimeters per second) divided by $\pi$ times the third power of the capillary radius (in centimeters), i.e., Shear rate $=4q/(\pi \times \text{radius}^3)$

I claim:

1. A method of extruding solution dyed polypropylene filaments, comprising:

feeding a mixture of polypropylene pellets and color concentrate to a screw of an extruder having a length/diameter ratio of at least 25:1, said screw having a screw flight extending the effective length of said screw, said screw flight defining a feed section, a transition section, and a metering section, the depth of undercut of said screw flight decreasing through said transition section in the direction of feed with the ratio of the depth of said undercut in said feed section to that in said metering section being at least 4.5:1, and the length of said transition section being at least the sum of the lengths of said feed and metering sections;

rotating said screw to feed said mixture therealong from said feed section;

applying external heat to said mixture in said transition section at a temperature less than 385° F. to melt said mixture before it reaches said metering section;

thoroughly mixing said melt during the passage thereof through said transition section;

applying external heat to said melt in said metering section at a temperature less than 385° F. and at least equal to the temperature of said melt; and extruding said melt at a controlled temperature less than 385° F. into a plurality of solution dyed filaments;

the relative dimensions of said transition section effecting efficient mixing of the melt therein while substantially eliminating the occurrence of an adiabatic condition therein with higher throughput rates of extrusion at low temperature.

2. A method of extruding polypropylene filaments or the like, comprising:

feeding polypropylene in the form of pellets to a feed section of an extruder;

passing the pellets to a long transition section of the extruder, said transition section decreasing in depth by a ratio of at least 4.5:1 from the beginning to the end thereof in the direction of feed and the extruder having a length/diameter ratio of at least 25:1;

melting the pellets in said transition section;

thoroughly mixing the melt in said transition section by substantial back flow of said melt therein;

controlling the temperature of said melt at less than 385° F. as said melt passes from said transition section by applying external heat to said transition section;

passing said melt through a metering section of the extruder, the length of said transition section being at least equal to the sum of the lengths of the metering and feed sections; and extruding said melt at a controlled temperature less than 385° F. into a plurality of said filaments or the like.

3. The method recited in claim 2, wherein said applying of heat to said transition section occurs at a plurality of locations along the length of said transition section, the heat being applied at a lower temperature the nearer the location is to the metering section.

4. The method recited in claim 2, wherein said transition section comprises two compression sections separated by a dwell section.

5. The method recited in claim 2, wherein said melt reaches a temperature in the range 335° F. to 365° F. in said transition section and is extruded at that temperature.

6. The method recited in claim 5, wherein said range is 340° F. to 355° F.

7. The method recited in claim 2, wherein said filaments are extruded as a plurality of multifilament yarns, each yarn being extruded at a rate greater than seven pounds per hour.

8. A method of producing solution dyed multifilament polypropylene yarn, comprising:

feeding a mixture of polypropylene and color concentrate to a screw in the extruder, said polypropylene having a narrow molecular weight distribution with a swell value of less than 3, and said extruder having a length/diameter ratio of 30:1, rotating said screw to pass said mixture along said screw to a long transition section thereof, said transition section being at least half the length of said screw, and said transition section having a compression ratio of at least 5:1 from the beginning to the end thereof;

melting said mixture to a melt in said transition section;

thoroughly mixing said melt in said long transition section by considerable back flow of said melt therein;

heating said melt in said transition section to a controlled temperature less than 425° F.;

extruding said melt at a controlled temperature less than 425° F. into a plurality of solution dyed filaments;

passing the filaments through a hot zone having a temperature sufficiently high to retard cooling of the filaments therein;

drawing down the filaments to their undrawn denier in said hot zone;

then passing the filaments through a quenching zone and directing cooling gas over the filaments in said quenching zone to cool them;

the combination of the swell value of the polypropylene, the low temperature of extrusion, and the temperature of said hot zone interacting to substantially eliminate the occurrence of resonance in the filaments as they are drawn down in said hot zone; and the relative dimensions of said transition section substantially eliminating the occurrence of adiabatic condition therein with higher throughput rates of extrusion at low temperature.

9. The method recited in claim 8, wherein said controlled temperatures are in the range 335° F. to 365° F.

10. The method recited in claim 8, wherein said controlled temperatures are in the range 350° F. to 360° F.

11. A method of extruding polypropylene filaments or the like, comprising:

feeding polypropylene to a feed section of an extruder having a length/diameter ratio of at least 25:1;

passing the polypropylene to a long transition section of the extruder, said transition section decreasing in depth by a ratio of at least 4.5:1 from the beginning to the end thereof in the direction of feed;

melting the polypropylene in said transition section;

thoroughly mixing the melt in said transition section by substantial back flow of said melt therein;

controlling the temperature of said melt at less than 385° F. as said melt passes from said transition section by applying external heat to said transition section, said heat being applied along a reverse temperature gradient commencing at a higher temperature at the beginning of said transition section and dropping to a lower temperature at the end thereof;

passing said melt through a metering section of the extruder, the length of said transition section being at least equal to the sum of the lengths of the metering and feed sections; and extruding said melt at a controlled temperature less than 385° F. into a plurality of said filaments or the like.

12. The method recited in claim 11, wherein said feed section is maintained at the melting point of the polypropylene.

* * * * *